United States Patent [19]

Gazda

[11] 4,007,798

[45] Feb. 15, 1977

[54] HYDRAULIC JAR

[75] Inventor: Imre I. Gazda, Saginaw, Tex.

[73] Assignee: Otis Engineering Corporation, Dallas, Tex.

[22] Filed: Oct. 6, 1975

[21] Appl. No.: 619,852

[52] U.S. Cl. ..... 175/297

[51] Int. Cl.[2] ..... E21B 1/10

[58] Field of Search ..... 175/297, 300, 304

[56] References Cited

UNITED STATES PATENTS

| | | | |
|---|---|---|---|
| 2,309,872 | 2/1943 | Shaffer et al. | 175/297 |
| 2,621,024 | 12/1952 | Koppl et al. | 175/297 |
| 2,740,479 | 4/1956 | Schwegman | 175/297 |
| 2,828,822 | 4/1958 | Greer | 175/297 |
| 2,851,110 | 9/1958 | Greer | 175/297 |
| 3,251,426 | 5/1966 | Lebourg | 175/297 |

*Primary Examiner*—James A. Leppink
*Attorney, Agent, or Firm*—Vinson Elkins Searls Connally & Smith

[57] ABSTRACT

Hydraulic jar comprising a housing, a piston axially movable within the housing, an anvil disposed within the housing, a hammer associated with the housing and means for maintaining the housing in a position with the hammer spaced from the anvil and then releasing the housing when the piston moves to a select, extended position.

26 Claims, 2 Drawing Figures

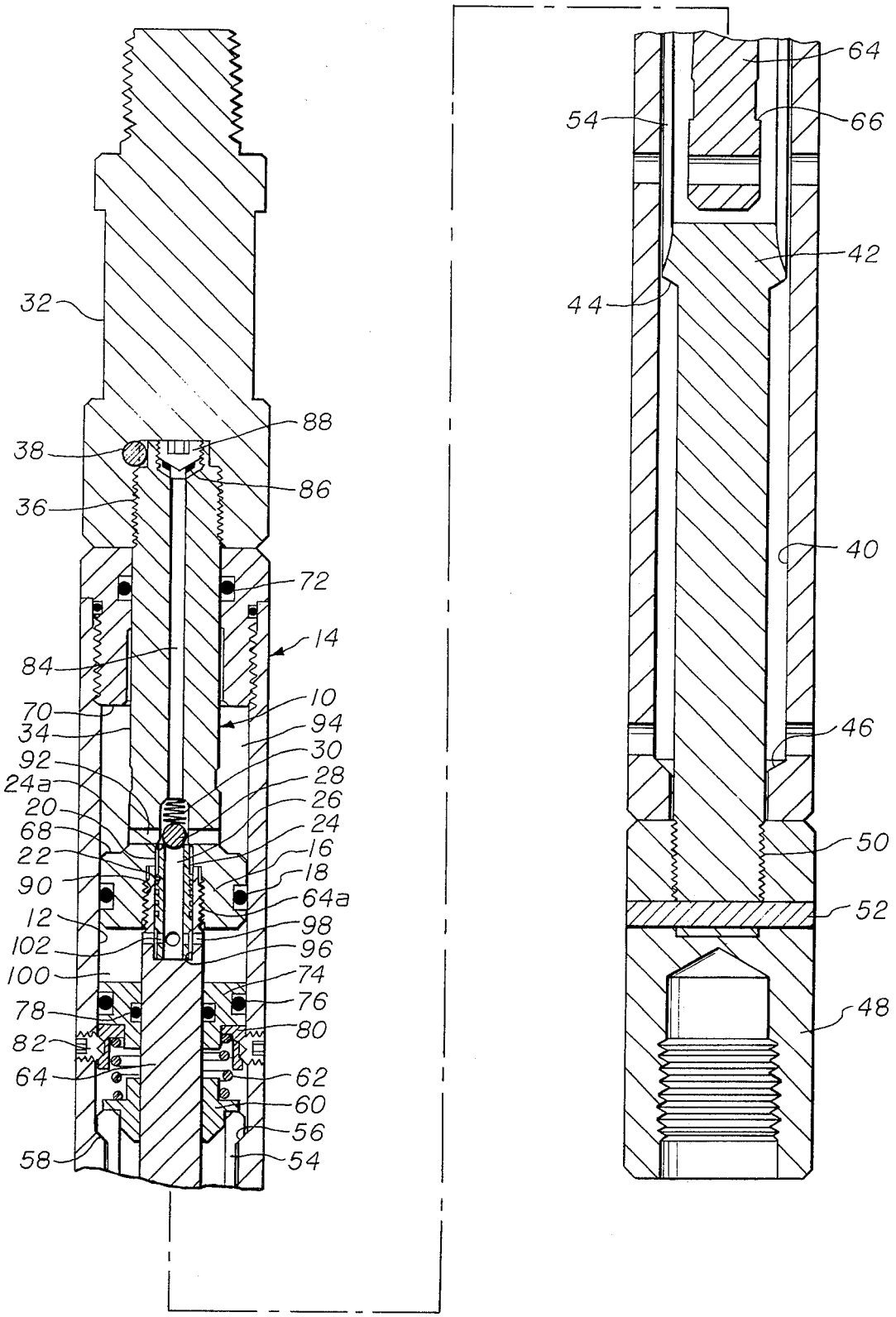
32
38
36
88
86
72
14
84
70
34
92
24a
20
68
22
90
12
102
100
78
82
64
58
10
94
30
28
26
24
16
18
64a
98
96
74
76
80
62
60
56
54
64
54
66
42
44
40
46
50
52
48

HYDRAULIC JAR

BACKGROUND OF THE INVENTION

1. Field of the Invention

This invention relates to jars for use in a tool string in a well and more specifically to a hydraulic jar for imparting an upward, impactive force to a tool.

2. The Prior Art

The use of a jar in a well tool string to impart an upward impactive force is well known. Jars may be either hydraulic or mechanical.

One common hydraulic jar is illustrated in U.S. Pat. No. 2,828,822 to Greer and in the "Composite Catalouge of Oil Field Service & Equipment", 1972–1973 edition Volume I page 683. This jar includes a piston in a cylinder housing having two different diameters at opposite ends.

However, the above jar has several operational and manufacturing deficiencies. Because the entire jaring stroke is done by the piston and cylinder, the tool is long. The high speed movement of the piston through the enlarged diameter portion of the cylinder wears the seals around the piston. To be able to obtain the desired retarding of fluid flow past the piston, a long elaborate packing element surrounds the piston and a small tolerance is provided between the reduced diameter portion and piston. The tolerance generally results in a lack of interchangeability of parts from one jar to another. Additionally when the jar is operated, the cylinder bore is occasionally gouged and a less restricted (e.g. faster) flow of fluid results. The manufacture of such a jar is difficult because the entire reduced diameter portion of the cylinder must be closely machined and the reduced diameter portion is in an inexcessible location for machining operations.

U.S. Pat. No. to Greer 2,851,110 also discloses a hydraulic jar. The jar is similar to that disclosed in the aforementioned patent except that instead of having an enlarged diameter portion, the jar has a cylinder having longitudinal grooves at one end through which fluid may flow around the piston. The jar also has the disadvantages of the aforementioned jar.

Mechanical jars including a spring and a hammer which is released to strike on anvil when the spring is stretched a selected extent are known. The major disadvantage with these types of jars is that there is no way of changing the amount of impactive force obtained from the jar while the jar is being used in the well. This is because the spring must be preset before the jar is positioned within the tool string. In use, the hammer is released when the spring is stretched this preset amount.

OBJECTS OF THE INVENTION

It is an object of this invention to provide a short, compact hydraulic jar.

Another object of this invention to provide a hydraulic jar wherein there is no fast flow of fluids past the piston seal to wear out the seal.

Another object of this invention to provide a jar with a mechanical means for releasing the hammer which jar has the ability to provide a varying impactive force.

Another object of this invention is to provide a hydraulic jar that is easier to manufacture by eliminating a long closely machined bore.

Another objection of this invention to provide a hydraulic jar that does not require a close tolerance between the bore of the housing and the piston to permit interchanging parts.

Another object of this invention is to provide a hydraulic jar which is less likely to gouge the housing bore.

These and other objects, features and advantages of this invention will be apparent from the drawings, the detailed description, and the appended claims.

BRIEF DESCRIPTION OF THE DRAWING

In the drawing wherein like numerals indicate like parts the FIGURE comprise a continuation drawing of a jar in a collapsed position.

DESCRIPTION OF THE PREFERRED EMBODIMENT

The jar includes an energy storing section, an energy releasing section, and a hammer and anvil section. The energy storing section impedes the movement of an upper sub which may be attached to a tool string associated with a wire line or other means of exerting a force. The impeded movement of the upper sub permits the wire line to be stretched when tension is applied to it at the surface. Stretching the wire line stores energy in the line. Once the upper sub has moved a select distance, the energy releasing section of the jar permits a sudden release of the stored energy and its conversion into kinetic energy. The kinetic energy is then applied by a hammer to impart an upward blow to an anvil. The anvil is attached to a lower sub which may be connected to a tool below the jar. The blow to the anvil imparts an upward impactive force to the tool.

The energy storing section includes an axially movable piston means 10 disposed within a cylinder means portion 12 of a floating housing means 14. The cylinder means portion 12 is designed to be charged with a fluid. Means are provided to impede the axial movement of the piston means 10 to permit the storage of energy by retarding the flow of fluid past the piston means 10. Means are also provided to permit the piston means 10 to return to a position permitting another operation of the jar by permitting free flow of fluid past the piston means 10. The retarded flow of fluid occurs when the piston means 10 is extended with respect to the housing means 14. The free flow of fluid occurs when the piston means 10 is moved to a contracted position within the housing means 14. To provide for a controlled, retarded flow of fluid past the piston means 10, the piston means 10 includes piston head means 16 around which seal means, such as O-ring 18, extends and through which extends a bleed passage means 20. The seal means 18 provides a sealing engagement with the cylinder means portion 12 and prevents fluid from flowing past the piston means in the annulus between the piston head means 16 and the cylinder means portion 12. With an O-ring utilized as the seal means 18, the need for a close tolerance between the outside diameter of the piston head means 16 and the inside diameter of the cylinder means portion 12 is eliminated thereby increasing the interchangeability of these parts.

The controlled, retarded flow of fluid past the piston means 10 may then be provided by the bleed passage means 20. Preferably, the bleed passage means includes labyrinth means such as grooves 22 in sleeve 24 to further retard the flow of fluid past the piston means 10.

To permit the free flow of fluid past the piston means a bypass passageway means 26 is provided. Included within the bypass passageway means 26 is a check valve means, including a ball valve 28 and a spring biasing means 30, to prevent free flow of fluid through the bypass passageway means 26 while the piston means 10 moves to an axially extended position.

For attachment to the upper sub means 32, which is adapted to the attached tool string means (not shown) the piston means 10 includes body means 34 extending upwardly from piston head means 16. Means for connecting the piston body means 34 to the upper sub means 32 are provided, such as threaded connection 36 and roll pin 38.

The energy releasing section of the jar and the hammer and anvil section of the jar are provided in a cage means portion 40 of the housing means 14.

The anvil means 42 is disposed within the cage means portion 40 and includes shoulder means 44 adapted to be struck by the hammer means 46 carried by the housing means 14. The anvil means 42 is attached to bottom sub means 48 by means of threaded connection 50 which is locked by roll pin 52. The bottom sub means 48 is adapted to be attached the tool means (not shown) to which it is desired to impart an unpward impactive force.

The hammer means 46 is carried by the housing 14 and is designed to strike shoulder 44 of the anvil means 42 to impart the upward impactive force. The housing means 14 is normally maintained in a position with the hammer means 46 spaced from the anvil means shoulder 44. The housing means 14 may then accelerate sufficiently upon release, by the energy release section, to expend the stored energy developed by the energies storing section. An impactive force of a desired magnitude may then be imparted when the hammer means 46 strikes the anvil means shoulder 44.

The energy release section of the jar provides the means by which the stored potential energy created by the energy storing section is converted into kinetic energy which can be used to impart the desired impactive force. The energy release section of the jar converts the potential energy into kinetic energy by releasing the housing means 14 for movement with respect to the anvil means 42. The energy releasing section of the jar performs its function by providing means for releasably maintaining the housing means in a position with the hammer means spaced from the anvil means until the piston means has moved to a select, extended position and then releasing the housing means. Means associated with the anvil means 42 are provided which are capable of releasably engaging stop means associated with the housing means 14 and retainer means are provided which retain the means associated with the anvil means 42 engaged with the stop means until the piston is moved to a select, extended position. The means associated with the anvil means 42 may be collet finger means 54 including chambered shoulder 56. The stop means associated with housing means 14 may be provided by chambered shoulder 58. A retainer collar means 60 may be provided which when disposed behind the collet finger means 54 maintains the chambered shoulder 56 of the collet finger means 54 engaged with the chambered shoulder 58 of the housing means 14. Spring biasing means 62 biases said retainer collar means to a position behind said collet finger means 54. To release the housing means when the piston means 10 has moved to the select, extended position, stinger means 64 are attached to said piston means 10 and engages retainer collar means 60 to move it out from behind the collet finger means 54, thereby permitting the collet finger means shoulder 56 to slide off of the housing means shoulder 58, when the piston means has moved to the select, extended position. To engage the retainer collar means 60 stinger 64 has a shoulder means 66.

Preferably, the select, extended position of the piston means 10, when the housing means 14 is released for movement with respect to the anvil means 42, is the extreme extended position of the piston means 10. The stopping of the axially extending movement of the piston means 10 when the housing means 14 is released, results in the piston means 10 and housing means 14 moving as a unit when the impactive, jarring force is imparted. With the piston means 10 stationary with respect to the housing means 14 at this time, there is less likelihood that seal means 18 will be pinched or worn. To stop the piston means 10 an upper shoulder means 68 of the piston head means 16 engages a downward facing bumper shoulder means 70 of the housing means 14. The length of the stinger means 64 is such that its shoulder 66 moves retainer collar means 60 out of engagement with the collet finger means 54 when piston head means' shoulder 68 engages bumper shoulder means 70.

Means are provided to confine hydraulic fluid within the cylinder means portion 12. Seal means 72 are provided at the upper end of the housing means 14 to seal with the piston body means 34. A floating piston means 74 separates the cylinder means portion 12 of the housing means 14 from the cage means portion 40. Seal means, such as O-ring 76, extend circumferentially around the floating piston means 74 to seal with the the means portion 12. The stinger means 64 extends through the floating piston means 74, and a seal means 78 is provided in the floating piston means 74 to seal with the stinger means 64. Stop means, such as collar 80 held in place by set screws 82, prevent floating piston means 74 from moving into the cage means portion 40. Bore means 84 is provided through the piston body means 34 to permit charging the cylinder means portion 12 with hydraulic fluid. The cylinder means portion 12 is charged with hydraulic fluid before upper sub means 32 is attached to the piston body means 34. When the cylinder means portion 12 is charged, gasket means 86 and set screw 88 are inserted in bore means 84 to confine the fluid within the cylinder means portion 12.

A simple construction is provided for the bleed passage means 20 and bypass passageway means 26 by the illustrated attachment of the stinger means 64 to the piston means 10 whereby the component parts may be easily machined and the size of the bleed passage means 20 easily controlled. The piston head means 16 includes threaded bore means 90 on the side opposite the piston body means 34. Passage means 92 through the piston means 10 communicate between the threaded bore means 90 and an upper chamber means 94 formed by the cylinder means portion 12 and the piston means 10. One end **64*a* of the stinger means 64 is threaded into the threaded bore means 90. This end 64*a* includes blind bore means 96. Communicating means 98 through the stinger means 64*a* communicate between this blind bore means 96 and lower chamber means 100 formed by piston head means 16, the cylinder means portion 12, and floating piston means 74. Sleeve means 24 is disposed in blind bore 96, preferably with a close tolerance fit between the outside diameter of the sleeve means 24 and the inside diameter of the blind bore 96. Bleed passage means is then provided by passage means 92, the annulus between sleeve means 24 and blind bore 96, and communicating means 98. Preferably, annular grooves 22 are machined into the outer surface of sleeve means 24 (although they could be machined into the inner surface of blind bore 96) to provide a rough contour so that a labyrinth passage is provided through bleed passage means 20. With this type of an arrangement for the bleed passage means 20, the only precise machining is to the blind bore 96 and the outer surface of the sleeve means 24, both of which are easily accessible when the component parts of the jar are being produced. The sleeve means 24 includes port means 102 which communicate between the bore of the sleeve means and communicating means 98. The bypass passage means 26 is then provided by passage means 92, the bore of the sleeve means 24, port means 102, and communicating means 98. The end 24a of the sleeve means 24** may be the seat means for the check valve means.

In operation, the jar is used when it is desired to impart an upward impactive force to an object stuck in a well. Tool means (not shown) attaches to the stuck object. Tension is applied to the wireline (not shown) to stretch it. The tension is transmitted through tool string means (not shown) to upper sub means 32, and an upward force is exerted on the piston means 10. The piston means 10 moves axially within the cylinder means portion 12; however, its upward movement is retarded by the restricted flow of fluid from the upper chamber means 94 through the bleed passage means 20. The retarding of fluid flow permits any desired tension and stretch to be applied to the wireline to create varying amounts of potential energy. When the piston reaches a select, extended position, with shoulder means 68 almost abuting bumper shoulder means 70, the shoulder means 66 of the stinger means 64 moves retainer collar means out of engagement with collet finger means 54. The housing means 14 is now free to accelerate upward. It rapidly moves until hammer means 46 engages anvil means 42 at which time an upward impactive force is imparted by the jar to the tool means and stuck object.

To return the jar to a collapsed position so that another impactive force may be imparted, the tension in the wireline is slacked off. Due to the weight of upper sub 32 and any sinker bars which may be attached thereto the piston means 10 moves axially to a contracted position with the hydraulic fluid flowing from lower chamber means 100 to upper chamber means 94 through bypass passage means 26. Housing means 14 also telescopes with respect to anvil means 42 until hammer means 46 again becomes spaced from the anvil means 42. When collet finger means 54 reengages stop means 58, spring biasing means 62 moves retainer collar means 60 back into engagement with collet finger means 54. Housing means 14 is now releasably maintained with the hammer means 46 spaced from the anvil means 42, and the jar is ready to be used again.

From the foregoing description it can be seen that the objects of this invention have been obtained and that a novel jar has been disclosed. The use of anvil means, piston means, lower sub means associated with the anvil means adapted for connection for tool means, upper sub means attached to the piston means adapted for attachment to tool string means, and tubular housing means floating between the lower sub means and upper sub means permits a shorter hydraulic jar than has heretofore been possible. The bleed passage means through the piston means eases the machineability of the parts of the jar in that a closely machined, long bore is no longer required. Additionally a simple seal, such as an O-ring, may be utilized around the piston head means rather than an elaborate packing element. With such a piston head and cylinder arrangement, there is less likelihood of gouging of the cylinder. Less seal wear occurs since there is no rapid flow of fluid pass the piston head. Additionally a mechanically releaseable hammer is provided and yet it is still possible to vary the impactive force imparted.

The foregoing disclosure and discription of the invention are illustrative and explanatory thereof and various changes in the size, shape and materials, as well as in the details of the illustrated construction may be made within the scope of the appended claims without departing from the spirit of the invention.

What is claimed is:

1. A hydraulic jar comprising:

tubular housing means including a cage means portion, hammer means, and a cylinder means portion;

piston means axially movable within said cylinder means portion;

bleed passage means through said piston means;

bypass passageway means through said piston means;

check valve means in said bypass passageway means limiting flow to one direction therethrough;

anvil means disposed within said cage means portion;

first sub means connected to said anvil means and adapted for connection to tool means;

second sub means attached to said piston means and adapted for attachment to tool string means; and means for releasably maintaining said housing means in a position with said hammer means spaced from said anvil means until said piston means moves to a select, extended position and then releasing said housing means to permit striking of said anvil means by said hammer means.

2. The hydraulic jar of claim 1 wherein said select extended position of said piston means is the extreme extended position of said piston means.

3. The hydraulic jar of claim 1 additionally including: shoulder means on said piston means; bumper shoulder means on said housing means; wherein at said select, extended position of said piston means, said shoulder means on said piston means engages said bumper shoulder means of said housing means to inhibit further movement of said piston means to an extended position.

4. The hydraulic jar of claim 1 wherein the means for releasably maintaining includes:

stop means in said cage means portion;

means associated with said anvil means releasably engageable with said stop means; and retainer means which retains said associated means engaged with said stop means until said piston means moves to a select, extended position.

5. The hydraulic jar of claim 1 including: floating piston means in said cylinder means portion separating said cylinder means portion from said cage means portion.

6. The hydraulic jar of claim 5 including: stop means for preventing said floating piston means from moving into said cage means portion.

7. The hydraulic jar of claim 1 including:

means for charging said cylinder means portion with fluid; and means for confining fluid in said cylinder means portion.

8. The hydraulic jar of claim 7 including:

a charge of fluid confined within said cylinder means portion.

9. The hydraulic jar of claim 1 wherein said piston means includes piston head means and piston body means; and seal means extend circumferentially around said piston head means for sealing engagement with said cylinder means portion.

10. A hydraulic jar comprising:

tubular housing means including a cage means portion, hammer means, and a cylinder means portion;

piston means axially movable within said cylinder means portion;

bleed passage means through said piston means;

bypass passageway means through said piston means;

check valve means in said bypass passageway means limiting flow to one direction therethrough;

anvil means disposed within said cage means portion;

collet finger means on said anvil means, stop means in said cage means portion to engage said collet finger means;

retainer collar means which while engaged with said collet finger means retains said collet finger means engaged with said stop means; and stinger means attached to said piston means for moving said retainer means out of engagement with said collet finger means when said piston means moves to a select, extended position.

11. The jar of claim 10 including:

means for biasing said retainer collar means to a position engaging said collet finger means.

12. A hydraulic jar comprising:

tubular housing means including a cage means portion, hammer means, and a cylinder means portion;

piston means axially movable within said cylinder means portion, said piston means including piston head means and piston body means;

bleed passage means through said piston means;

bypass passageway means through said piston means;

check valve means in said bypass passageway means limiting flow to one direction therethrough;

anvil means disposed within said cage means portion;

means for releasably maintaining said housing means in a position with said hammer means spaced from said anvil means until said piston means moves to a select, extended position and then releasing said housing means to permit striking of said anvil means by said hammer means;

floating piston means axially movable within said cylinder means portion separating one end of said cylinder means portion from said cage means portion;

threaded bore means in said piston head means on the side opposite said piston body means;

passage means through said piston body means communicating between said threaded bore means and chamber means formed by said cylinder means and said piston means;

stinger means threaded into said threaded bore means;

blind bore means in the end of said stinger means that is threaded into said threaded bore means;

communicating means through said stinger means communicating between said blind bore means and chamber means formed by said cylinder means, said piston head means, and floating piston means;

sleeve means in said blind bore means with the outer surface of said sleeve means having a close tolerance fit with the inner surface of said blind bore means;

one of the inner surface of said bore means and the outer surface of said sleeve means having a rough contour; and port means through said sleeve means communicating between the bore of said sleeve means and said communicating means through said stinger means;

whereby said bleed passage means is provided by said passage means through the piston body means, the annulus between said sleeve means and said blind bore means, and said communicating means; and whereby said bypass passageway means is provided by said passage means through the piston body means, the bore of said sleeve means, said port means, and said communicating means.

13. A hydraulic jar comprising:

anvil means;

first sub means associated with said anvil means and adapted for connection to tool means, piston means;

second sub means attached to said piston means and adapted for attachment to tool string means;

tubular housing means floating between said two sub means including a cylinder means portion surrounding said piston means and a cage means portion surrounding said anvil means;

bleed passage means through said piston means;

bypass passageway means through said piston means;

hammer means associated with said cage means portion for striking said anvil means;

means for releasably maintaining said housing means in a position with said first sub means adjacent said housing means until said piston means is extended to a select, extended position and then releasing said housing means.

14. The hydraulic jar of claim 13 wherein said select, extended position of said piston means is the extreme extended position of said piston means.

15. The hydraulic jar of claim 13 additionally including: shoulder means on said piston means; bumper shoulder means on said housing means; wherein at said select, extended position of said piston means, said shoulder means on said piston means engages said bumper shoulder means of said housing means to inhibit further movement of said piston means to an extend position.

16. The hydraulic jar of claim 13 wherein the means for releasably maintaining includes:

stop means in said cage means portion;

means associated with said anvil means releasably engageable with said stop means; and retainer means which retains said means engaged with said stop means until said piston means is moved to a select, extended position.

17. The jar of claim 13 including:

floating piston means axially movable within said cylinder means portion separating said cylinder means portion from said cage means portion.

18. The jar of claim 17 including:

stop means for preventing said floating piston means from moving into said cage means portion.

19. The jar of claim 13 including:
means for charging said cylinder means portion with fluid; and
means for confining fluid in said cylinder means portion.

20. The jar of claim 19 including:
a charge of fluid confined within said cylinder means portion.

21. The jar of claim 13 wherein
said piston means includes piston head means and piston body means; and
said piston head means has seal means extending circumferentially therearound for sealing engagement with the cylinder means of said cylinder means portion.

22. A hydraulic jar comprising;
anvil means;
first sub means associated with said anvil means and adapted for connection to tool means;
piston means;
second sub means attached to said piston means and adapted for attachment to tool string means;
tubular housing means floating between said two sub means including a cylinder means portion surrounding said piston means and a cage means portion surrounding said anvil means;
bleed passage means through said piston means;
bypass passageway means through said piston means;
hammer means associated with said cage means portion for striking said anvil means;
collet finger means on said anvil means,
stop means in said cage means portion to engage said collet finger means,
retainer collar means which while engaged with said collet finger means retains said collet finger means engaged with said stop means, and
stinger means attached to said piston means for moving said retainer means out of engagement with said collet finger means when said piston means moves to a select, extended position.

23. The jar of claim 22 including
means for biasing said retainer means to a position engaging said collet finger means.

24. A hydraulic jar comprising:
anvil means;
first sub means associated with said anvil means and adapted for connection to tool means;
piston means including piston head means and piston body means;
second sub means attached to said piston body means and adapted for attachment to tool string means;
tubular housing means floating between said two sub means including a cylinder means portion surrounding said piston means and a cage means portion surrounding said anvil means;
bleed passage means through said piston means;
bypass passageway means through said piston means;
hammer means associated with said cage means portion for striking said anvil means;
means for releasably maintaining said housing means in a position with said first sub means adjacent said housing means until said piston means is moved to a select, extended position and then releasing said housing means;
floating piston means axially movable within said cylinder means portion separating said cylinder means portion from said cage means portion;
threaded bore means in said piston head means on the side opposite said piston body means;
passage means through said piston body means communicating between said threaded bore means and chamber means formed by said cylinder means and said piston means;
stinger means threaded into said threaded bore means;
blind bore means in the end of said stinger means that is threaded into said threaded bore means;
communicating means through said stinger means communicating between said blind bore means and chamber means formed by said cylinder means, said piston head means, and said floating piston means;
sleeve means in said blind bore means with the outer surface of said sleeve means having a close tolerance fit with the inner surface of said blind bore means;
one of the inner surface of said bore means and the outer surface of said sleeve means having a rough contour; and
port means through said sleeve means communicating between the bore of said sleeve means and said communicating means through said stinger means;
whereby said bleed passage means is provided by said passage means through the piston body means, the annulus between said sleeve means and said blind bore means, and said communicating means; and
whereby said bypass passageway means is provided by said passage means through the piston body means, the bore of said sleeve means, said port means, and said communicating means.

25. A hydraulic jar comprising:
tubular housing means including a cage means portion and a cylinder means portion;
piston means, including piston head means and body means, axially movable within said cylinder means portion;
seal means extending circumferentially about said piston head means for sealing engagement with said cylinder means portion;
first sub means attached to said body means and adapted to be attached to tool string means;
bleed passage means through said piston means;
bypass passageway means through said piston means;
check valve means to close said bypass passageway means while said piston means moves to an extended position;
floating piston means axially movable within said cylinder means portion separating said cylinder means portion from said cage means portion;
first stop means in said housing means for preventing said floating piston means from moving into said cage means portion;
anvil means disposed within said cage means portion;
collet finger means on said anvil means;
second stop means in said cage means portion to engage said collet finger means;
retainer collar means which while engaged with said collet finger means retains said collet finger means engaged with said second stop means;
means for biasing said retainer means to a collet finger means engaging position;
stinger means attached to said piston head means extending through said floating piston means for moving said retainer collar means out of engagement with said collet finger means when said piston means moves to a select, extended position;

hammer means carried by said housing means for striking said anvil means;

said hammer means being releasably maintained spaced from said anvil means when said collet finger means are engaged with said second stop means;

said housing means being released when said retainer means is moved out of engagement with said collet finger means;

shoulder means on said body means;

shoulder means on said housing means which engages said shoulder means on said body means to inhibit further movement of said piston means to an extended position at said select, extended position;

means for injecting fluid into said cylinder means portion;

means for confining fluid in said cylinder means portion;

a charge of fluid confined within said cylinder means portion;

threaded bore means in said piston head means on the side opposite said piston body means;

passage means through said piston body means communicating between said threaded bore means and chamber means formed by said cylinder means and said piston means;

one end of said stinger means being threaded into said threaded bore means;

blind bore means in said one end of said stinger means;

communicating means through said stinger means communicating between said blind bore means and chamber means formed by said cylinder means, said piston head means, and said floating piston means;

sleeve means in said blind bore means with the outer surface of said sleeve means having a close tolerance fit with the inner surface of said blind bore means;

one of the inner surface of said bore means and the outer surface of said sleeve means having a rough contour; and port means through said sleeve means communicating between the bore of said sleeve means and said communicating means through said stinger means;

whereby said bleed passage means is provided by said passage means through the piston body means, the annulus between said sleeve means and said blind bore means, and said communicating means; and whereby said bypass passageway is provided by said passage means through the piston body means, the bore of said sleeve means, said port means, and said communicating means.

26. A hydraulic jar comprising:

tubular housing means including a cage means portion, hammer means, and a cylinder means portion;

anvil means disposed within said cage means portion;

first sub means connected to said anvil means and adapted for connection to tool means;

piston means disposed within said cylinder means portion;

second sub means associated with said piston means and adapted for attachment to tool string means;

means for releasably maintaining said housing means in a position with said hammer means spaced from said anvil means until said piston means moves to a select, extended position and then releasing said housing means to permit striking of said anvil means by said hammer means;

said piston means being movable from an initial position to said select, extended position by said second sub means when said second sub means moves away from said first sub means and being movable from said select, extended position to said initial position by said second sub means when said second sub means moves towards said first sub means.

* * * * *